US011700923B2

(12) United States Patent
Schmidt

(10) Patent No.: US 11,700,923 B2
(45) Date of Patent: Jul. 18, 2023

(54) STEALTH MICRO-BALLISTIC BILLFOLD

(71) Applicant: Steven H. Schmidt, Elk Grove, CA (US)

(72) Inventor: Steven H. Schmidt, Elk Grove, CA (US)

( * ) Notice: Subject to any disclaimer, the term of this patent is extended or adjusted under 35 U.S.C. 154(b) by 170 days.

(21) Appl. No.: 16/949,219

(22) Filed: Oct. 20, 2020

(65) Prior Publication Data

US 2021/0120924 A1 Apr. 29, 2021

Related U.S. Application Data

(60) Provisional application No. 62/926,898, filed on Oct. 28, 2019.

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC ..... A45C 1/06; A45C 2001/065
USPC ..... 229/72; 150/147
See application file for complete search history.

(56) References Cited

U.S. PATENT DOCUMENTS 932,205 A 8/1909 Wentz
1,683,996 A * 9/1928 Snow ..... A45C 11/18 150/147
1,799,383 A * 4/1931 Mayer ..... A45C 1/06 150/145
2,455,515 A * 12/1948 Miller ..... A45C 1/06 D3/250
2,575,030 A * 11/1951 Smallman ..... A45C 1/06 150/145
2,597,967 A * 5/1952 Anderson ..... A45C 1/06 24/511

(Continued)

FOREIGN PATENT DOCUMENTS

CA 2686101 A1 * 5/2011 ..... A45C 11/182
KR 200476722 Y1 * 3/2015 ..... A45C 13/20

OTHER PUBLICATIONS

Emma Kites: https://www.amazon.com/emma-kites-EMMAKITES-2200lbs-Polyethylene/dp/B01NAIZU2C (Year: 2016).*

(Continued)

*Primary Examiner* — John K Fristoe, Jr.
*Assistant Examiner* — Justin Caudill
(74) *Attorney, Agent, or Firm* — Innovation Capital Law Group, LLP; Vic Lin

(57) ABSTRACT

A wallet is designed to be folded in half along a central bill loop that can hold paper currency thereunder. The opened wallet, on each side of the bill loop, can include a card slot formed therein. When opened, the wallet can have four corners that, when folded, meet to form two outside corners of the folded wallet while two inside corners are formed at ends of the folded portion. The left-side card slot can be offset from the right-side card slot such that, when folded, cards in the left-side card slot can provide support adjacent one outside corner of the wallet, while cards in the right-side card slot can provide support adjacent the other outside corner of the wallet. Thus, the wallet is structurally supportive without requiring any additional elements to provide such support, outside of the user's own cards stored in the wallet.

20 Claims, 8 Drawing Sheets

(56) References Cited

U.S. PATENT DOCUMENTS 2,658,545 A * 11/1953 Weydener ..... A45C 1/06 D19/27
2,719,557 A * 10/1955 Bell ..... A45C 1/06 D3/250
D181,550 S * 11/1957 Rubeck ..... D3/250
2,816,590 A * 12/1957 Boots ..... A45C 1/06 150/137
2,876,518 A * 3/1959 Shears ..... B42F 11/00 150/147
D185,346 S * 6/1959 Chase ..... D3/247
3,018,532 A * 1/1962 Rinaldi ..... B42F 7/04 281/46
3,454,069 A * 7/1969 Machler ..... A45C 1/06 150/137
4,907,634 A * 3/1990 Yoo ..... A45C 1/06 150/135
5,423,363 A * 6/1995 Matzdorff ..... A45C 1/06 150/149
6,668,883 B2 * 12/2003 Buechele ..... A45C 1/06 150/147
D772,567 S * 11/2016 Tappeiner ..... D3/247
9,969,204 B2 * 5/2018 Miller ..... B42F 9/005
2001/0032690 A1 * 10/2001 Gribovsky ..... A45C 11/182 150/137
2004/0108032 A1 * 6/2004 Lyons ..... A45C 1/06 150/132
2010/0109845 A1 * 5/2010 Stewart-Stand ..... A45C 1/06 150/131
2012/0061268 A1 * 3/2012 Turner ..... A45F 5/00 40/633
2013/0276943 A1 * 10/2013 Minn ..... A45C 1/06 150/137
2016/0073747 A1 * 3/2016 Whichel ..... A45C 13/02 150/118
2017/0112248 A1 * 4/2017 Haarburger ..... A45C 13/001
2018/0332936 A1 * 11/2018 Serman ..... A45C 11/182
2019/0246758 A1 * 8/2019 Herrington ..... G06K 19/07737

OTHER PUBLICATIONS

Bellroy: https://www.amazon.com/dp/B07F1SWYTD/ (Year: 2013).*
Zitahli: https://www.amazon.com/Zitahli-Compartment-Leather-Wallets-Minimalist/dp/B0B2LNK2PB (Year: 2019).*
Slimfold: https://www.amazon.com/SlimFold-Minimalist-RFID-Wallet-Waterproof/dp/B01N9J4NU9/ (Year: 2015).*
https://www.slimwalletdude.com, Jul. 28, 2017.
https://www.themodestman.com/slim-wallets/, Mar. 7, 2015.

* cited by examiner

STEALTH MICRO-BALLISTIC BILLFOLD

CROSS-REFERENCE TO RELATED APPLICATION

This application claims the benefit of priority of U.S. provisional patent application No. 62/926,898, filed Oct. 28, 2019, the contents of which are herein incorporated by reference.

BACKGROUND OF THE INVENTION

Field of the Invention

Embodiments of the invention relate generally to carrying devices. More particularly, the invention relates to apparatus and methods of carrying cards and bills in a manner more effective than prior art billfold wallets and bi-fold designs, solving modern problems with previously unachievable results.

Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The modern billfold was patented over 99 years ago by Bill Wentz (U.S. Pat. No. 932,205) and is still the universal standard used around the world. The modern-day credit card, aka "the charge plate," was initially invented and first adopted in 1928. Wallets, and specifically bi-fold wallet designs, were created to hold these new cards. Ever since then, as consumer credit and membership cards have grown more widely popular, wallet and bi-fold designs have changed to accommodate an increasing number of credit and business cards with the only true changes being advancements in materials and some design changes over the last 20 years.

Many users, including competitive athletes, find that the thinner-than-most classic wallet can put pressure and stress on their Sciatic nerve, which can lead to lower back pain. Because of this, many people have the habit of removing their wallet from their back pocket whenever they would sit until they could stand again. This can cause many stressful times when their wallet is left behind and/or lost. For users that may find themselves needing to sit or lie down for extended periods, such as due to having to spend multiple hours in a hospital emergency room bed, leg and lower back pain can became unbearable due to the medical condition colloquially known as "wallet sciatica." To alleviate the pain, such a person would need to pull their wallet out and placed it next to they on their bed. This, however, could lead to misplacement or theft of the now unsecured wallet.

In view of the foregoing, there is a need for an improved apparatus and device for carrying cards and currency.

SUMMARY OF THE INVENTION

Now, over 99 years later, embodiments of the present invention provide a new classic billfold designed to hold bills, cards, ID, and paper. The billfold reduces the size footprint to carry what needs to be carried and improves how users carry their necessary items every day.

The billfold design, according to aspects of the present invention, amends the classic design via a structure that allows for a billfold wallet to measure significantly thinner than other advertised, published billfold/wallets claiming to be the world's slimmest wallet or bi-fold. The stealth micro-ballistic billfold solves many problems and frustrations the modern wallet user encounters daily. Each of these changes comes with a dramatic increase in wallet longevity and everyday usefulness. This new design should accommodate the modern user with many achieved results for the next 100 years or until society stops using bills and modern driver's licenses, ID's, credit cards, membership cards, and gift cards altogether.

What makes the stealth billfold revolutionary and completely unique includes the structural card placement design of the stealth bi-fold itself. This new design does not require an added internal skeleton structure, or even any at all, for superior function. In addition, the micro-ballistic bill loop design allows for the function of a clip but many times thinner and more cut proof than any traditional bill clip made out metal without the normal problems associated, like wearing out pockets or leather and wallet sciatica.

Embodiments of the present invention provide a wallet comprising an outside layer; an inside layer attached to the outside layer, the inside layer and the outside layer having a long axis and a short axis orthogonal to the long axis; a left side slot disposed in a left side of the inside layer; a right side slot disposed in a right side of the inside layer, wherein the left side slot is offset from a right side slot; and a micro-ballistic cord centrally disposed and extending along the short axis of an exterior of the inside layer.

Embodiments of the present invention further provide a wallet comprising an outside layer; an inside layer attached to the outside layer about an outer perimeter thereof, the inside layer and the outside layer having a long axis and a short axis orthogonal to the long axis; a left side slot disposed in a left side of the inside layer along the short axis thereof, adjacent a central short axis of the inside layer; a right side slot disposed in a right side of the inside layer along the short axis thereof, adjacent the central short axis of the inside layer, wherein the left side slot is offset vertically from a right side slot; and a cord extending along the central short axis at an exterior of the inside layer.

Embodiments of the present invention also provide a wallet comprising an outside layer; an inside layer attached to the outside layer about an outer perimeter thereof, the inside layer and the outside layer having a long axis and a short axis orthogonal to the long axis; a left side slot disposed in a left side of the inside layer along the short axis thereof, adjacent a central short axis of the inside layer; a right side slot disposed in a right side of the inside layer along the short axis thereof, adjacent the central short axis of the inside layer, wherein the left side slot is offset vertically from a right side slot; and a cord extending along the central short axis at an exterior of the inside layer, the cord being a continuous loop, extending through holes at a top and a bottom portion of the inside layer, the loop further extending between the inside layer and the outside layer of the wallet.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
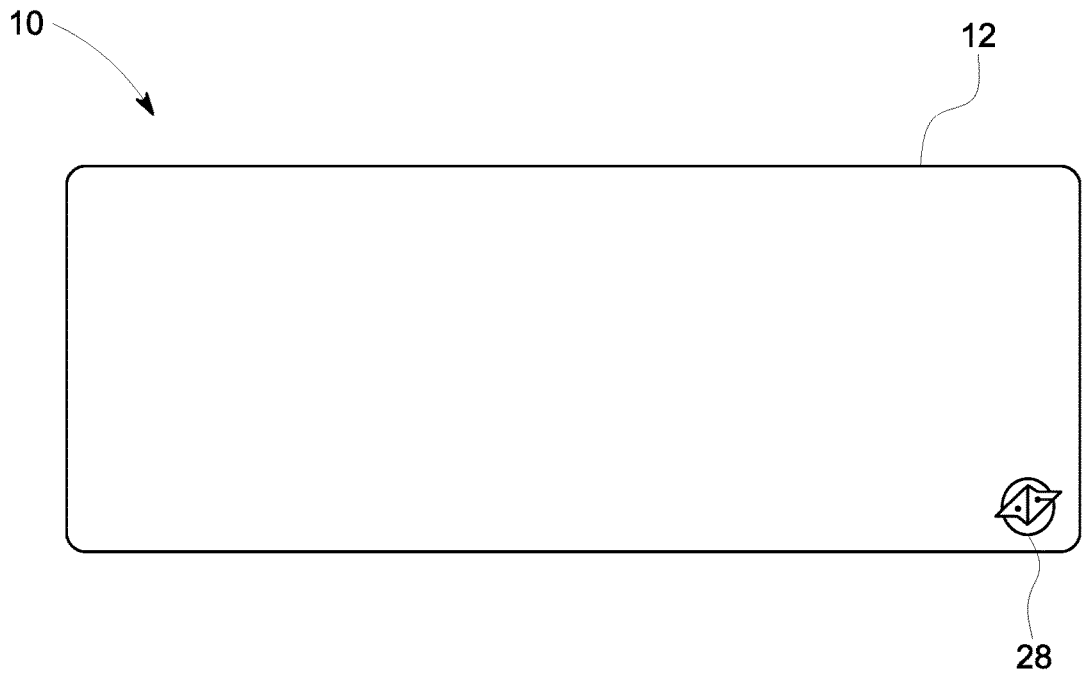
FIG. 1A illustrates an outside layer of a wallet according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a wallet that is designed to be folded in half along a central bill loop that can hold paper currency thereunder. The opened wallet, on each side of the bill loop, can include a card slot formed therein. When opened, the wallet can have four corners that, when folded, meet to form two outside corners of the folded wallet while two inside corners are formed at ends of the folded portion. The left-side card slot can be offset from the right-side card slot such that, when folded, cards in the left-side card slot can provide support adjacent one outside corner of the wallet, while cards in the right-side card slot can provide support adjacent the other outside corner of the wallet. Thus, the wallet is structurally supportive without requiring any additional elements to provide such support, outside of the user's own cards stored in the wallet.

The unique design of the stealth billfold, according to aspects of the present invention, is that the wallet itself does not need to have any added skeletal structure material to hold shape when folded. Once any card (ID, gift, credit, membership, or the like) is placed in each of the two diagonally opposing/offset card pockets, the cards become the wallet's structural skeleton. As the size of most credit cards is 85.60 mm×53.98 mm and rounded corners with a radius of 2.8"/3.48 mm, conforming to the ISO/IEC 7810 ID-1 standard, the same size as ATM cards and other payment cards, such as debit cards, wallet design according to aspects of the present invention accommodates that card size. This design allows cards to lay flat rather than bending or cracking, as they do often, in card slots that are layered and offset with traditionally layered card slots. With the stealth billfold, according to aspects of the present invention, a design where cards are stacked flat can reduce the overall thickness in conjunction with the removal of fabricated or added material structure. Such slots can each typically hold from one to up to four or more cards.

As discussed in greater detail below, the wallet design according to aspects of the present invention, can be made out of only two pieces of material and the micro-ballistic bill loop. No internal material is required to be added for shape, structure, rigidness, or the like.

As further discussed in greater detail below, the wallet design according to aspects of the present invention can work regardless of whether the card slots are configured to slide in and out to the left, right, or upward. Also, the wallet design according to aspects of the present invention can function even if only one card is placed in each corner, as long as they are positioned in diagonally opposing card slots. In other words, the card slot pockets are offset into opposing diagonal corners of the bi-fold wallet when it is opened and lying flat. Because of this, when the wallet is closed, the card on each side on opposite corners becomes a hard inner shell. This design breaks barriers that experts have said were impossible to overcome related to thickness, material longevity, capacity, and features.

Another feature novel to the stealth bi-fold wallet, according to aspects of the present invention, that decreases thickness and is a new, unique, and revolutionary "micro-ballistic bill loop," which is many times thinner than a cash clip. The micro-ballistic bill loop is a thin, strong, and flexible single-purpose cash holder. While most cash clips are made out of steel or brass, the micro-ballistic bill loop is a rotating bill loop that is, for example, 15 times stronger per weight than steel and can be considered the world's strongest micro bungee cord. The bill loop bungee is made out of elastic wrapped in a material called ultra-high molecular weight polyethylene (UHMWPE). This otherwise called "money clip" is a loop of approximately 0.30 mm-1.5 mm thin, typically less than 1.0 mm, that is knotted or welded into a round loop through holes that have been cut into the inside layer of the wallet. One half of the loop is visible inside the billfold to hold bills and the other half is stealthily held inside the two layers of bi-fold material. This design allows for the loop to be infinitely rotated to decrease wear on the loop when the bills are slid in and out thousands of times.

As a result of the invention, garment pockets will last longer, look better, and stealth billfold users will not have annoying pocket wear lines. The wallet of the present invention is engineered to last by its flat-laying card laying design. Materials can be used that have a very high tear strength, such as premium leather, composite fabrics, carbon fiber and the like.

The modern trend toward minimalism and more form-fitting clothing like skinny jeans has been to own fewer, higher-quality products that fit the body better than ever before. For the last 99 years, however, since the card slot first became useful, wallet-makers have been focused on maximizing capacity rather than minimizing it, so one of the problems that the billfold of the present invention solves is a relatively new, modern problem.

Modern medicine has also recently made noticeably clear the negative effects of a thick wallet on chronic back pain due to spine misalignment for long periods of time. Humans also sit more than ever before in history as we spend a steadily increasing number of hours per day looking at screens.

Often, in many cultures, people look for complex, technologically-advanced solutions to simple problems. For example, someone created a wallet with a built-in Bluetooth-enabled location tracker. While it is a great solution for people who set down their wallets somewhere and lose them, it is an unnecessarily complex and expensive solution. Aspects of the present invention provide a wallet that is so thin that a user never has to take it out of their pocket to get lost in the first place. There is no need to find one's wallet if it can stay with you all the time, whether working at the office, watching a movie, commuting, working out at the gym, or riding a bicycle. The wallet, according to aspects of the present invention, features exactly these improvements.

Another reason for an improved wallet design is new development in materials and textiles technology. New materials have been invented that are progressively stronger, thinner, and advanced—materials like RFID frequency-blocking fabrics. In addition, improvements on traditional materials, such as leather, have also developed with nano-abrasion coatings, waterproof coatings, mold-resistant coatings, and more. The wallet, according to aspects of the present invention, can take advantage of some or many of these developments in materials and textiles technology.

The wallet design, according to aspects of the present invention, achieves many results, most of which offering significant improvements over conventional designs.

With the wallet, according to aspects of the present invention, cards can last longer by lying flat in the two card slots. The wallet, according to aspects of the present invention, can be better for the health of the user. Studies have shown that sitting on a thick, bulky wallet for prolonged periods of time will negatively affect and misalign the spine which causes chronic back pain and discomfort.

With the wallet, according to aspects of the present invention, there is less chance of being a victim of pick-pockets, as a thinner wallet may be more difficult to maneuver out of a user's pockets. Further, carriers of the wallet, according to aspects of the present invention, no longer have to worry about taking out their wallet whenever they want to sit down and leaving it behind. The wallet, according to aspects of the present invention, can be lighter, overall, as compared to conventional wallets.

The wallet, according to aspects of the present invention, can provide improvements in the way the user looks, with no more bulgy wallet or worn pocket lines on pants and other garments.

A minimalist wallet, such as the wallet, according to aspects of the present invention, can save users money because a person is potentially not carrying any membership or discount cards in the practice of minimalism. Thus, the user may think twice about going into the store to buy something they may or may not need. According to experts, carrying less cash also correlates to less overall spending.

With the wallet, according to aspects of the present invention, pockets in garments do not wear out as fast and there is a decrease in the frequent expense of washing stretched-out pants. Much of the time, people do not wash their jeans just because they are dirty, they wash them because they have stretched out during the day and the fit is not as comfortable or as appealing. A big wallet creates a saggy profile, so most people wash. While a user could spray with water or a mixed liquid to shrink the fibers back but that takes time, money for fast dries, and creates further damage to the fibers.

The wallet, according to aspects of the present invention, can improves user organization because there is no capacity for disorganization. Users of slim wallets cannot just put every card that they have and every bill they receive inside. Because of that reduced capacity and a limited amount of space inside the wallet, users need to think about what cards they really need to carry.

Finally, with the wallet, according to aspects of the present invention, it can be easier to find the card you need with greater speed of access. The time spent awkwardly digging through one's old receipts and redundant loyalty cards desperately looking for the card needed in a busy commerce location can be drastically reduced.

Figure 1B:
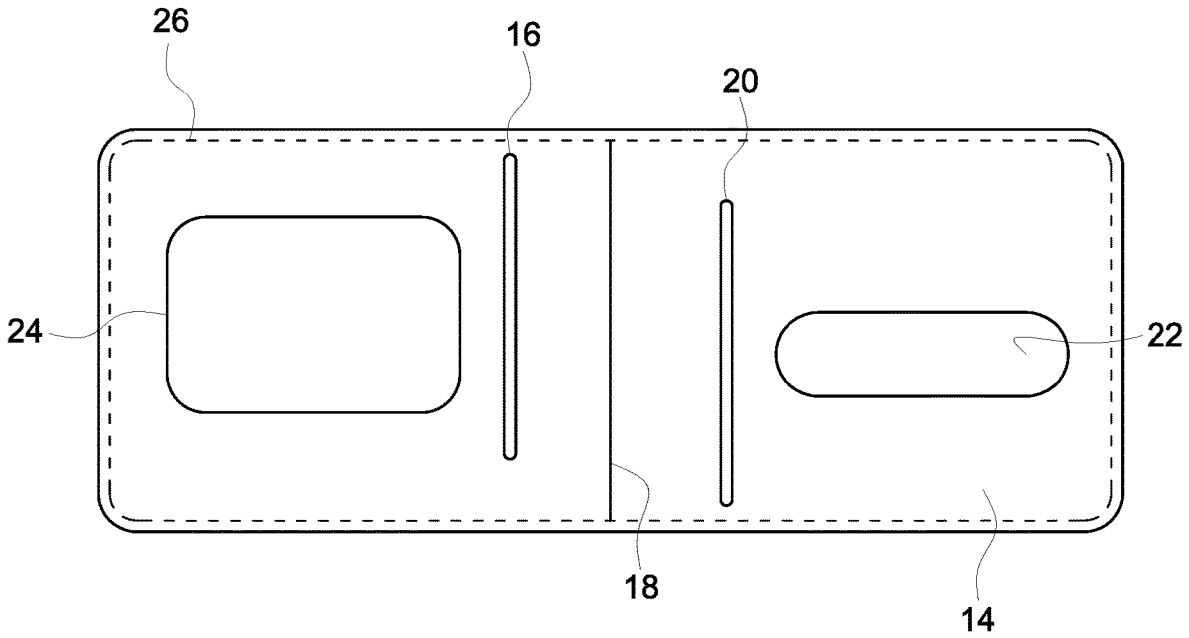
FIG. 1B illustrates an inside layer of a wallet, combinable with the outside layer of FIG. 1A to form the wallet, according to an exemplary embodiment of the present invention.

Referring now to FIGS. 1A and 1B, a wallet 10 can be formed from an outside layer 12 and an inside layer 14. The layers 12, 14 can be bonded together about an outer periphery thereof. For example, stitching 26 may be disposed about an outer perimeter of the wallet 10 to join the two layers 12, 14 together. Other edge coatings may be used to further enhance the edges and the connection between the layers 12, 14. A logo region 28 can optionally be provided on an exterior surface of the wallet 10.

A left side slot 16 may be cut along a short axis of inside layer 14. The left side slot 16 may be positioned left of the center short axis of the inside layer 14. The left side slot 16 may extend from directly adjacent an upper side edge of the inside layer 14. The left side slot 16 may terminate a distance away from a lower side edge of the inside layer 14.

A right side slot 20 may be cut along a short axis of inner layer 14. The right side slot 20 may be positioned right of the center short axis of the inside layer 14. The right side slot 20 may extend from directly adjacent the lower side edge of the inside layer 14. The right side slot 20 may terminate a distance away from the upper side edge of the inside layer 14.

Thus, the vertical position of the left side slot 16 may be offset from the vertical position of the right side slot 20.

A window 24 may be present on the left side of the inside layer 14 and a window 22 may be present on the right side of the inside layer 14. The windows 24, 22 may permit a user to see an upper most card stored in the respective slots 16, 20.

Figure 4:
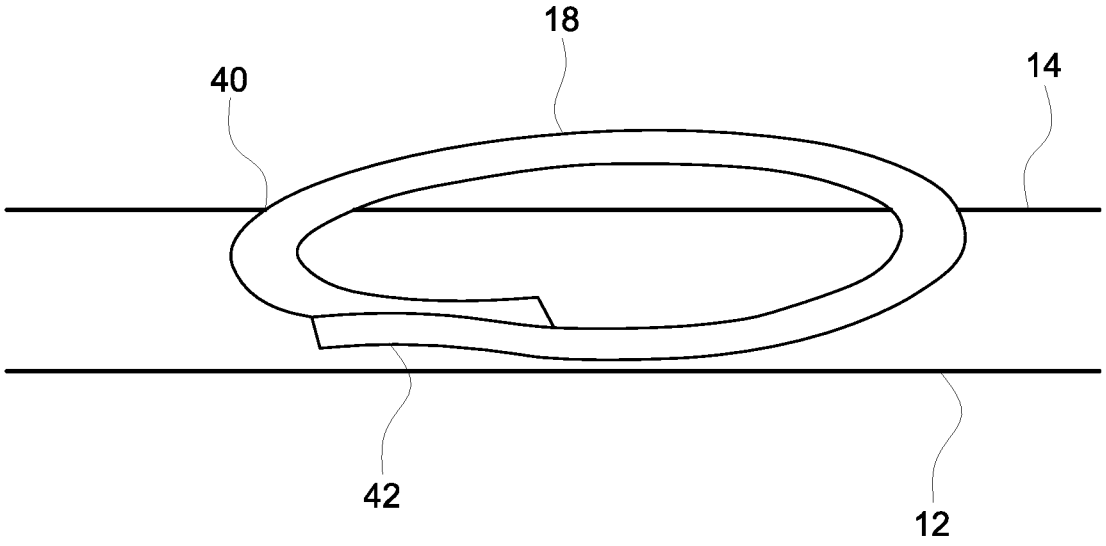
FIG. 4 illustrates a detail view of a bill loop extending between the inside and outside layers of the wallet of FIG. 3A.

A micro-ballistic cord 18, also referred to simply as cord 18, may be disposed in a loop, extending along an exterior surface, along the short axis fo the inside layer 14. The cord 18 may enter into holes 40 (see FIG. 4) in the inside layer 14 to extend along a back side of the inside layer 14, inbetween the inside layer 14 and the outside layer 12. As discussed above, the cord 18 is a thin, strong, and flexible single-purpose cash holder. In some embodiments, the cord 18 can be made out of elastic wrapped in a material called ultra-high molecular weight polyethylene (UHMWPE). The cord 18 can be approximately 0.30 mm-1.5 mm in diameter, typically less than 1.0 mm in diameter, and may be knotted or welded 42 (see FIG. 4) into a round loop through holes 40 that have been cut into the inside layer 14 of the wallet 10.

Figure 2A:
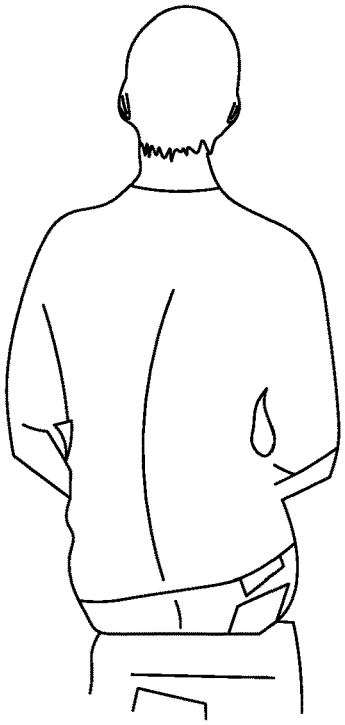
FIG. 2A (PRIOR ART)
FIG. 2A illustrates a user sitting with a conventional wallet in their back pocket, causing an offset seating position and unnatural pressure on the user's body.
Figure 2B:
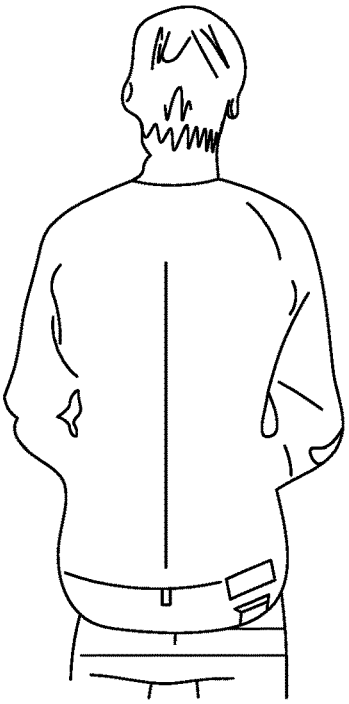
FIG. 2B illustrates a user sitting with the wallet according to aspects of the present invention in their back pocket.

Referring now to FIGS. 2A and 2B, it can be seen how, in FIG. 2A, a conventional wallet can cause a seated person to lean, placing unhealthy pressure and curvature to the user's hips and spine. As discussed above, this can result in painfun and/or long-term health issues. To the contrary, the wallet of the present invention is thin and allows a user to sit flat, as shown in FIG. 2B, when the wallet is in the user's back pocket.

Figure 3A:
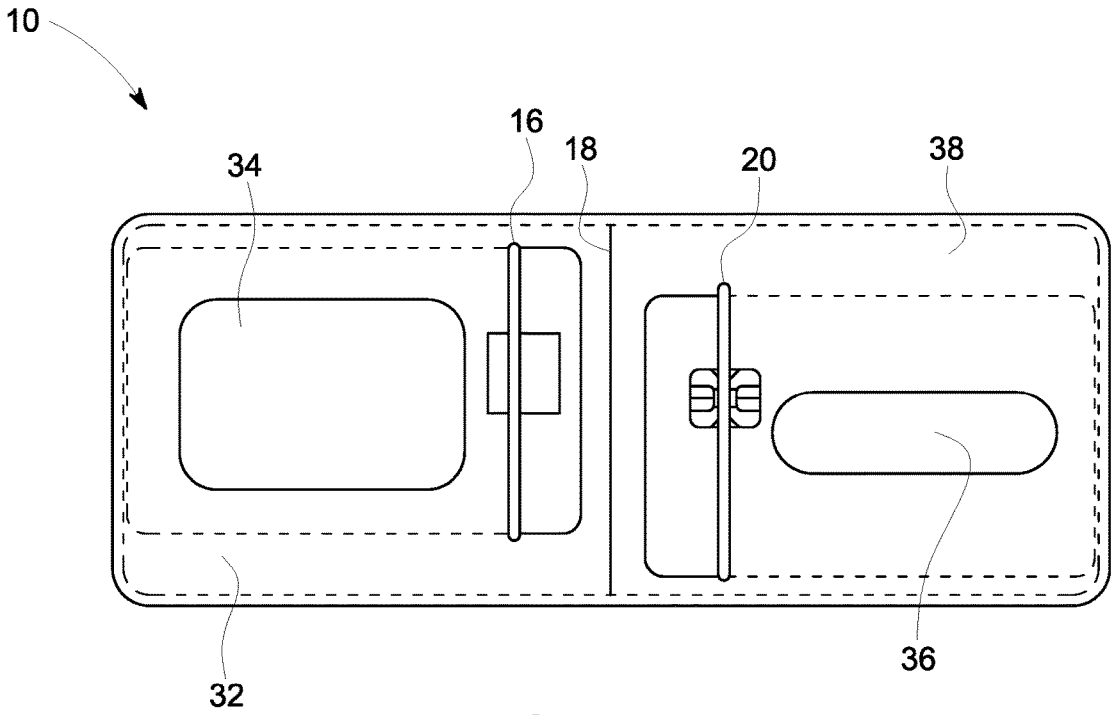
FIG. 3A illustrates an inside, opened view of a wallet according to an exemplary embodiment of the present invention.
Figure 3B:
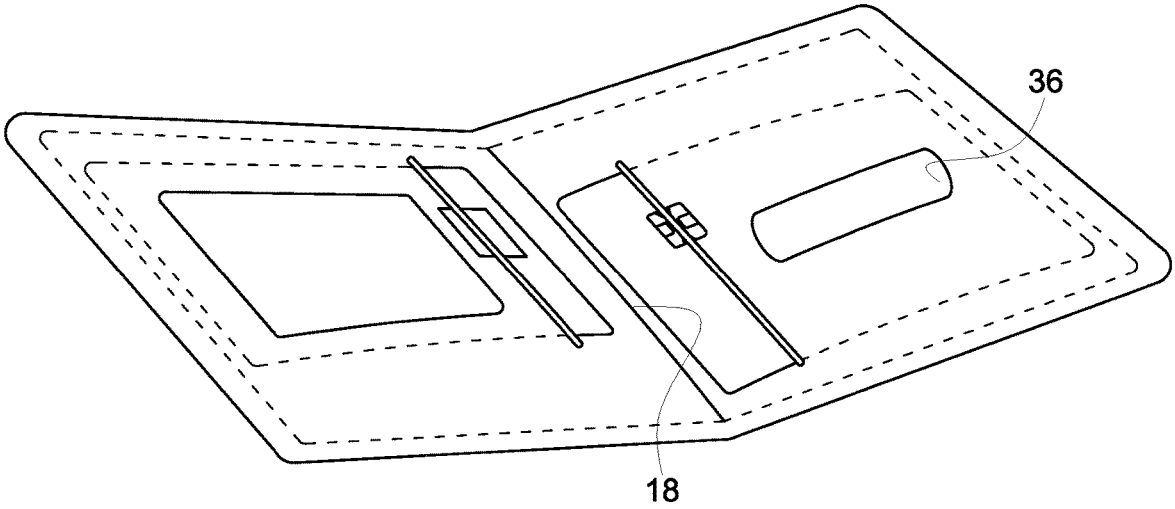
FIG. 3B illustrates a perspective view of the opened wallet of FIG. 3A.

FIGS. 3A and 3B illustrates the wallet 10, assembled, with cards 34, 36 inserted into respective slots 16, 20. As can be seen, the card 34 in the left side slot 16 may extend toward and be positioned adjacent the upper left corner of the wallet 10 when opened. A space 32 may be positioned below the card 34 and the exterior of the wallet 10. The card 36 in the right side slot 18 may extend toward and be positioned adjacent the lower right corner of the wallet 10 when opened. A space 38 may be positioned above the card 36 and the exterior of the wallet 10.

Each card 34, 36 may be positioned, at two adjacent sides of the card, along the stitching 26 (see FIG. 1B) that holds the layers 12, 14 together. Thus, when the wallet 10 is folded, the cards 34, 36 will extend adjacent the entire outer periphery of the wallet. The cards 34, 36, thus, can provide a rigid structure for the wallet 10, eliminating the need for structural inserts, or the like, that are often formed into conventional wallets. Thus, the wallet 10 can be made thinner and lighter than conventional wallets, without compromising strength thereof during use with cards in the left and right side slots 16, 20.

Figure 5:
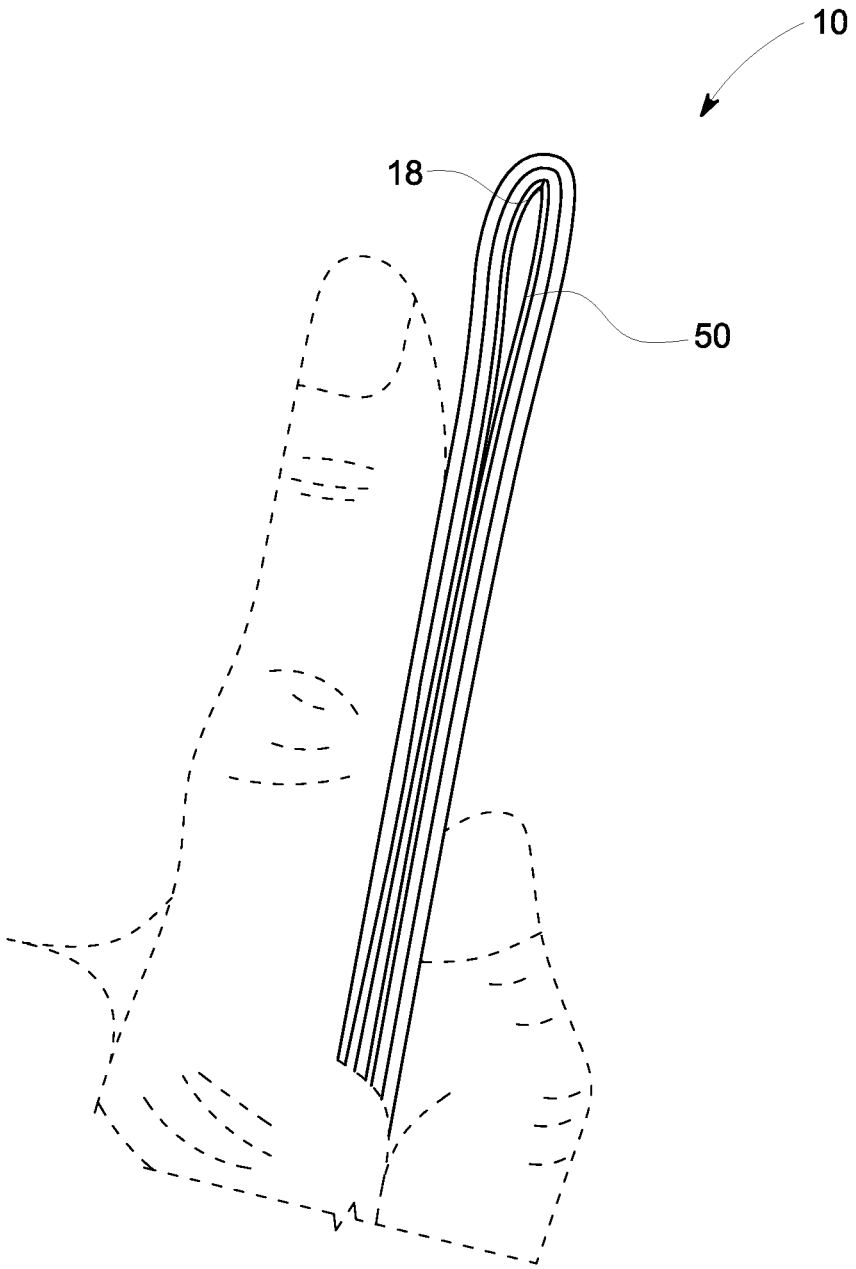
FIG. 5 illustrates the wallet of FIG. 3A held in a user's hand.

FIG. 5 shows the wallet 10 in a user's hand, with paper currency 50 disposed under the cord 18. As can be seen, the wallet 10 is thin and, with cards on each side of the wallet, the wallet 10 can be squeezed from side to side and maintain its flat structure due to the contents, not due to artificial inserts or structural supports, as in conventional wallets.

Figure 6:
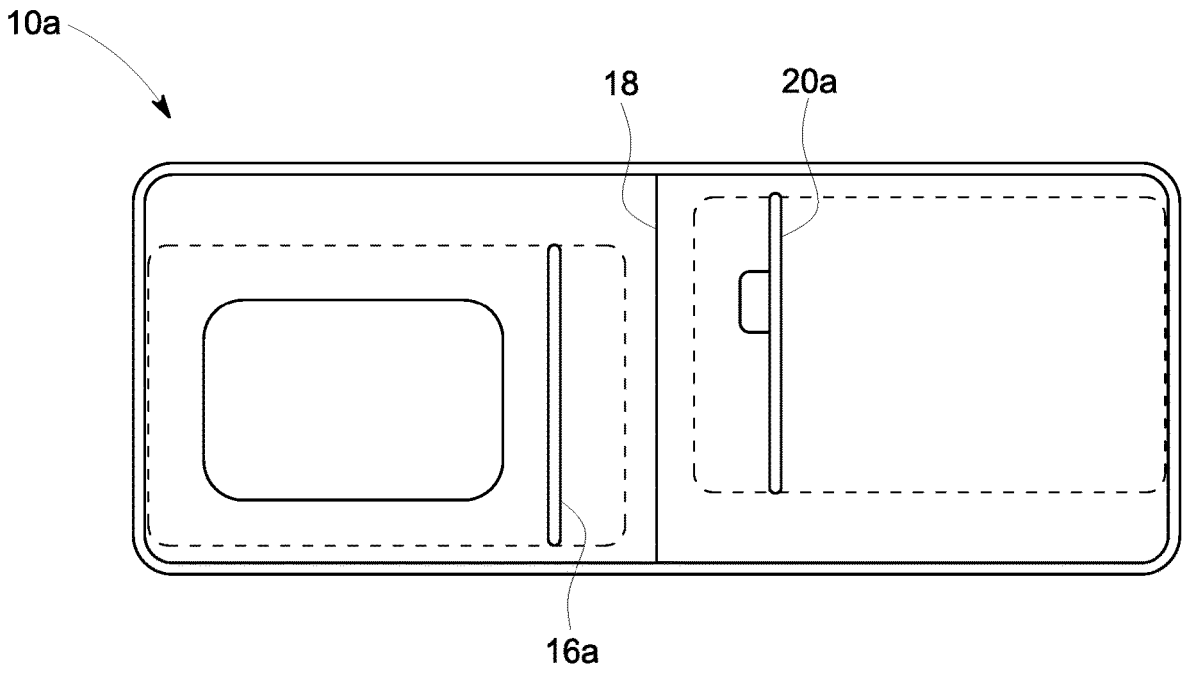
FIG. 6 illustrates an inside, opened view of a wallet having a left-side-lower design, according to an embodiment of the present invention.

Referring to FIG. 6, in an alternate embodiment, the left side of the open wallet 10*a*, may include a left side slot 16*a* that extends from the bottom of the wallet 10. A right side slot 20*a* may extend from the top of the wallet 10*a*. Thus, the slots 16*a*, 20*a* are offset similarly, but oppositely, from the slots 16, 20 discussed above with respect to FIGS. 1A and 3A. The effects are the same as the above embodiment. Cards (as shown in dashed lines) may be inserted into respective slots 16*a*, 20*a*. As can be seen, the card in the left side slot 16*a* may extend toward and be positioned adjacent the lower left corner of the wallet 10*a* when opened. A space may be positioned above the card and the exterior of the wallet 10*a*. The card in the right side slot 18*a* may extend toward and be positioned adjacent the upper right corner of the wallet 10*a* when opened. A space may be positioned below the card and the exterior of the wallet 10*a*.

Each card may be positioned, at two adjacent sides of the card, along the stitching 26 (see FIG. 1B) that holds the layers 12, 14 together. Thus, when the wallet 10*a* is folded, the cards can extend adjacent the entire outer periphery of the wallet. The cards, thus, can provide a rigid structure for the wallet 10*a*, eliminating the need for structural inserts, or the like, that are often formed into conventional wallets.

Figure 7:
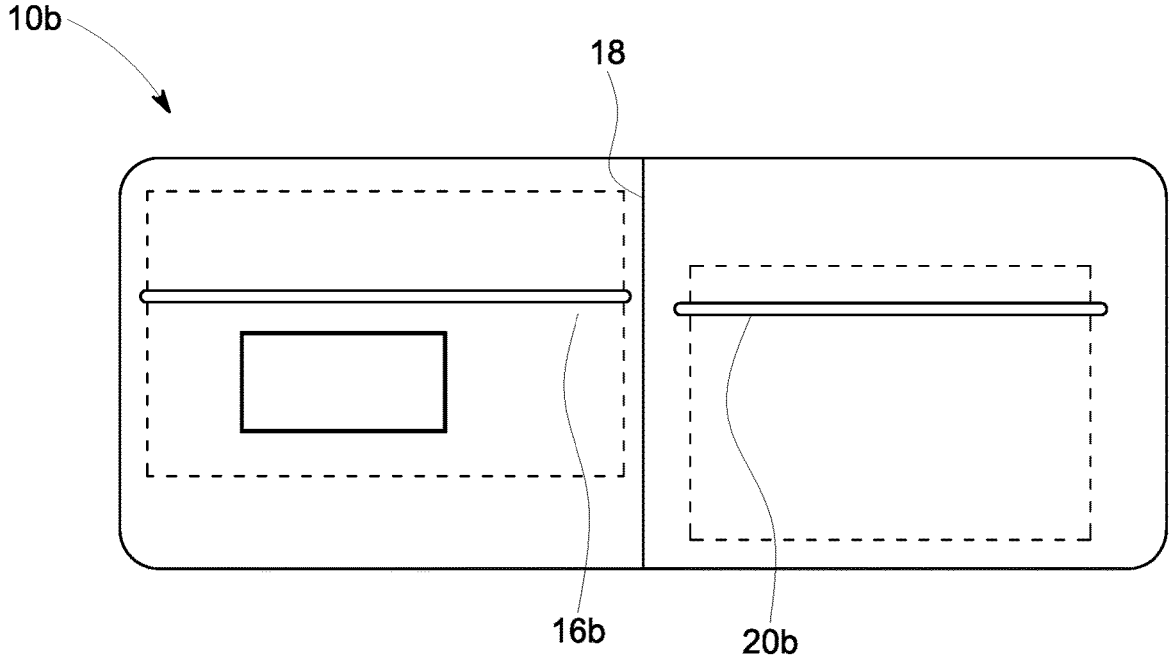
FIG. 7 illustrates an inside, opened view of a wallet having offset, horizontal slots, according to an embodiment of the present invention.

Referring to FIG. 7, left side slot 16*b* and right side slot 20*b* may be horizontal slots, formed along a long axis of the opened wallet 10*b*. The slots 16*b*, 20*b* amy be offset so that a card in the left side slot 16*b* may fit adjacent the top and left sides of the open wallet 10*b* and a card in the right side slot 20*b* may fit adjaect the bottom and right sides of the open wallet 10*b*. Thus, when the wallet 10*a* is folded, the cards can extend adjacent the entire outer periphery of the wallet. The cards, thus, can provide a rigid structure for the wallet 10*a*, eliminating the need for structural inserts, or the like, that are often formed into conventional wallets.

Figure 8A:
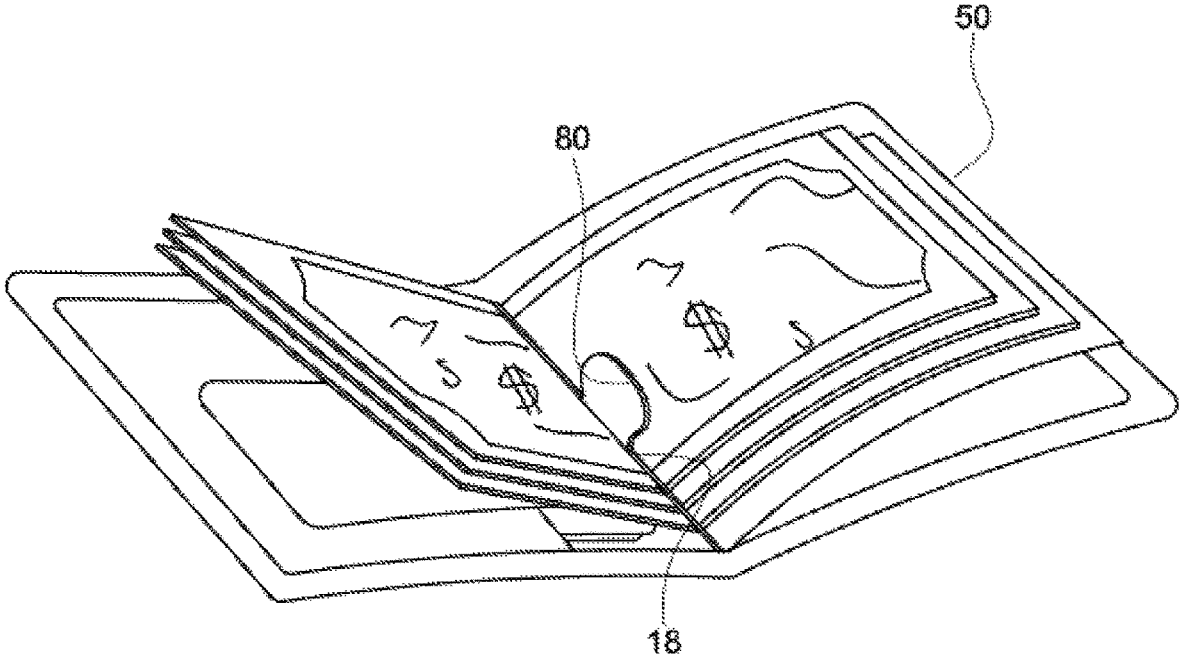
FIG. 8A illustrates an inside, opened view of a wallet having a pull tab on the bill loop, according to an exemplary embodiment of the present invention.
Figure 8B:
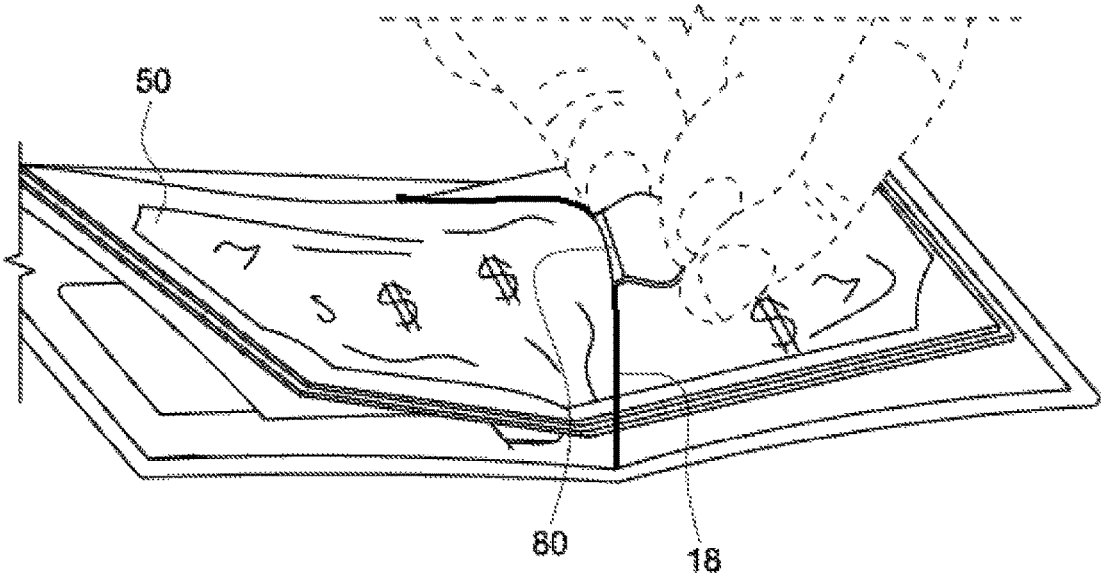
FIG. 8B illustrates a user elastically deforming the bill loop using the pull tab, according to an exemplary embodiment of the present invention.

Referring to FIGS. 8A and 8B, in some embodiments, the wallet can include one or more pull tabs 80 disposed on a portion of the cord 18. The pull tab 80 can provide a convenient handle for elastically deforming the cord 18 to make it more easy to place or remove paper currency 50 thereunder.

Figure 9A:
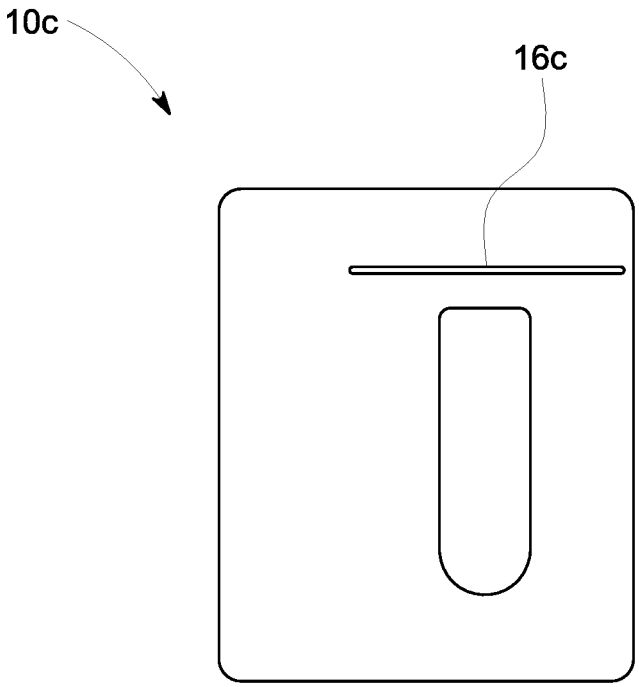
FIG. 9A illustrates an exterior view of a first side of an exterior-access-type wallet according to an exemplary embodiment of the present invention.
Figure 9B:
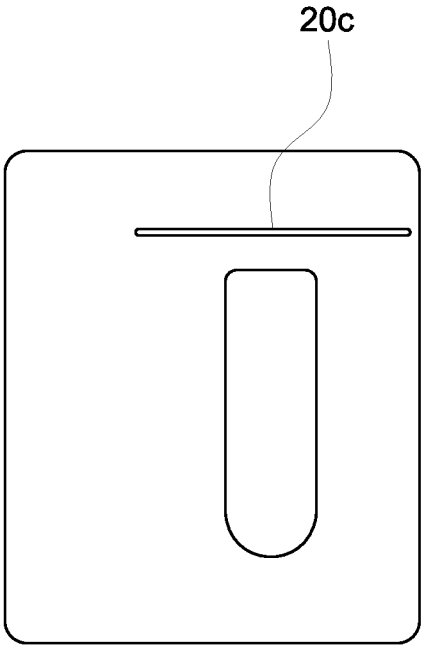
FIG. 9B illustrates an exterior view of a second side, bondable with the first side of FIG. 9A, to form an exterior-access-type wallet according to an exemplary embodiment of the present invention.

Referring to FIGS. 9A and 9B, in an alternate embodiment, a first layer (FIG. 9A) can include a slot 16*c* and a second layer (FIG. 9B) can include a slot 20*c*. The layers can be stitched back-to-back so that the slots are on the exterior of each side. When this is done, the slots 16*c*, 20*c* will be offset, where a card in slot 16*c* will extend along one side of the wallet 10*c* and a card in slot 20*c* will extend along the opposite side of the wallet 10*c*.

While the figures show certain design considerations, changes may be made without affecting the inventive features thereof. For example, the overall look could be changed for fashion or pocket design changes. For example, a larger corner radius may be implemented for these reasons.

In some embodiments, the wallet may be composed of different materials. Exemplary material embodiments are full grain leather and composite fabrics. However, other materials such as carbon fiber, sail cloth, recycled woven materials, organic materials using wood pulp, mushrooms, recycled petroleum, natural rubber materials, recycled sail cloth, recycled protective clothing such as firefighter's pants and protective athletic clothing, recycled nylon seat belts, and so forth, may also be used. The specifics of how thin the bi-fold wallet, according to aspects of the present invention, will measure, can be directly proportional to the material used.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A wallet comprising:

an outside layer;

an inside layer attached to the outside layer, the inside layer and the outside layer having a long axis and a short axis orthogonal to the long axis;

a single left side slot disposed in a left side of the inside layer;

a single right side slot disposed in a right side of the inside layer, wherein the left side slot is disposed at an offset from the right side slot; and a micro-ballistic cord centrally disposed and extending along the short axis of an exterior of the inside layer, wherein the inside layer is separated into the left side and the right side by a central axis;

the offset is defined where a first location of the left side slot is at a vertically different position and/or a horizontally different position on the left side as compared to a second location of the right side slot on the right side; and when the slot extends along the short axis of the wallet, the offset causes the left side slot to terminate prior to reaching a first edge of the inside layer opposite a second edge of the inside layer adjacent which the slot originates, and the offset causes the right side slot to terminate prior to reaching the second edge, where the second slot originates adjacent the first edge.

2. The wallet of claim 1, wherein the inside layer includes one or more windows formed to permit viewing a face of a card inserted in at least one of the left side slot and the right side slot.

3. The wallet of claim 1, wherein the left side slot and the right side slot are disposed along the short axis of the inside layer.

4. The wallet of claim 3, wherein the left side slot extends from adjacent a top side edge of the wallet and the right side slot extends from adjacent a bottom side edge of the wallet.

5. The wallet of claim 4, wherein:

when a first card is inserted in the left side slot, two adjacent sides of the first card extend along a top side and along a portion of left side of the wallet along a bottom side of the wallet; and when a second card is inserted in the right side slot, two adjacent sides of the second card extend along the bottom side and along a portion of a right side of the wallet.

6. The wallet of claim 5, wherein, when the wallet is folded along the micro-ballistic cord, and the first card and the second card are inserted, respectively, into the left side slot and the right side slot, the first and second cards provide support along an entirety of an outer perimeter of the folded wallet.

7. The wallet of claim 3, wherein the left side slot extends from adjacent a bottom side edge of the wallet and the right side slot extends from adjacent a top side edge of the wallet.

8. The wallet of claim 7, wherein:

when a first card is inserted in the left side slot, two adjacent sides of the first card extend along a bottom side and along a portion of a left side of the wallet;

when a second card is inserted in the right side slot, two adjacent sides of the second card extend along the top side and along a portion of a right side of the wallet; and when the wallet is folded along the micro-ballistic cord, and the first card and the second card are inserted, respectively, into the left side slot and the right side slot, the first and second cards provide support along an entirety of an outer perimeter of the folded wallet.

9. The wallet of claim 1, wherein the left side slot and the right side slot are disposed along the long axis of the inside layer.

10. The wallet of claim 9, wherein:

when a first card is inserted in the left side slot, two adjacent sides of the first card extend along a top side and along a portion of a left side of the wallet along a bottom side of the wallet;

when a second card is inserted in the right side slot, two adjacent sides of the second card extend along the bottom side and along a portion of a right side of the wallet; and when the wallet is folded along the micro-ballistic cord, and the first card and the second card are inserted, respectively, into the left side slot and the right side slot, the first and second cards provide support along an entirety of an outer perimeter of the folded wallet.

11. The wallet of claim 1, further comprising one or more pull tabs disposed along a portion of the cord.

12. The wallet of claim 1, wherein the cord is an elastic cord.

13. The wallet of claim 1, wherein the cord is a continuous loop of cord, extending through holes at a top and a bottom portion of the inside layer, the loop further extending between the inside layer and the outside layer of the wallet.

14. A wallet comprising:

an outside layer;

an inside layer attached to the outside layer about an outer perimeter thereof, the inside layer and the outside layer having a long axis and a short axis orthogonal to the long axis;

a single left side slot disposed in a left side of the inside layer along the short axis thereof, adjacent a central short axis of the inside layer;

a single right side slot disposed in a right side of the inside layer along the short axis thereof, adjacent the central short axis of the inside layer, wherein the left side slot is offset vertically from the right side slot; and a cord extending along the central short axis at an exterior of the inside layer, wherein the inside layer is separated into the left side and the right side by the central short axis;

the offset is defined where a first location of the left side slot is at a vertically different position and/or a horizontally different position on the left side as compared to a second location of the right side slot on the right side; and when the slot extends along the short axis of the wallet, the offset causes the left side slot to terminate prior to reaching a first edge of the inside layer opposite a second edge of the inside layer adjacent which the slot originates, and the offset causes the right side slot to terminate prior to reaching the second edge, where the second slot originates adjacent the first edge.

15. The wallet of claim 14, wherein the inside layer includes one or more windows formed to permit viewing a face of a card inserted in at least one of the left side slot and the right side slot.

16. The wallet of claim 14, wherein:

when a first card is inserted in the left side slot, two adjacent sides of the first card extend along a first side and along a portion of left side of the wallet along a second side of the wallet;

when a second card is inserted in the right side slot, two adjacent sides of the second card extend along the second side and along a portion of a right side of the wallet; and the first side and the second side are opposite sides of the wallet spanning between the left side and the right side of the wallet.

17. The wallet of claim 14, wherein, when the wallet is folded along the micro-ballistic cord, and a first card and a second card are inserted, respectively, into the left side slot and the right side slot, the first and second cards provide support along an entirety of an outer perimeter of the folded wallet.

18. The wallet of claim 14, further comprising one or more pull tabs disposed along a portion of the cord.

19. A wallet comprising:

an outside layer;

an inside layer attached to the outside layer about an outer perimeter thereof, the inside layer and the outside layer having a long axis and a short axis orthogonal to the long axis;

a single left side slot disposed in a left side of the inside layer along the short axis thereof, adjacent a central short axis of the inside layer;

a single right side slot disposed in a right side of the inside layer along the short axis thereof, adjacent the central short axis of the inside layer, wherein the left side slot is offset vertically from the right side slot; and a cord extending along the central short axis at an exterior of the inside layer, the cord being a continuous loop, extending through holes at a top and a bottom portion of the inside layer, the loop further extending between the inside layer and the outside layer of the wallet, wherein the inside layer is separated into the left side and the right side by the central short axis;

the offset is defined where a first location of the left side slot is at a vertically different position and/or a horizontally different position on the left side as compared to a second location of the right side slot on the right side; and when the slot extends along the short axis of the wallet, the offset causes the left side slot to terminate prior to reaching a first edge of the inside layer opposite a second edge of the inside layer adjacent which the slot originates, and the offset causes the right side slot to terminate prior to reaching the second edge, where the second slot originates adjacent the first edge.

20. The wallet of claim 19, wherein:

when a first card is inserted in the left side slot, two adjacent sides of the first card extend along a first side and along a portion of left side of the wallet;

when a second card is inserted in the right side slot, two adjacent sides of the second card extend along the second side and along a portion of a right side of the wallet;

the first side and the second side are opposite sides of the wallet spanning between the left side and the right side of the wallet; and when the wallet is folded along the micro-ballistic cord, and a first card and a second card are inserted, respectively, into the left side slot and the right side slot, the first and second cards provide support along an entirety of an outer perimeter of the folded wallet.

* * * * *